United States Patent [19]

Nawa

[11] 4,389,956

[45] Jun. 28, 1983

[54] COLOR CODED PRESSER FOOT ASSEMBLY

[75] Inventor: Hideo Nawa, Chiryu, Japan

[73] Assignee: Aisin Seiki Kabushiki Kaisha, Kariya, Japan

[21] Appl. No.: 210,800

[22] Filed: Nov. 26, 1980

Related U.S. Application Data

[63] Continuation-in-part of Ser. No. 3,420, Jan. 15, 1979, abandoned.

[30] Foreign Application Priority Data

Jan. 18, 1978 [JP] Japan ..... 53-4245

[51] Int. Cl.[3] ..... D05B 29/12

[52] U.S. Cl. ..... 112/240; 112/158 F

[58] Field of Search ..... 112/240, 235, 236, 158 R, 112/158 F, 222

[56] References Cited

U.S. PATENT DOCUMENTS

| | | | |
|---|---|---|---|
| 2,706,460 | 4/1955 | Grossman | 112/235 |
| 3,233,569 | 2/1966 | Euguchi | 112/235 X |
| 3,254,618 | 6/1966 | Euguchi | 112/158 C |
| 3,489,114 | 1/1970 | Seck | 112/240 |
| 3,656,443 | 4/1972 | Ross | 112/235 |
| 3,854,433 | 12/1974 | Hanyo | 112/235 |
| 4,052,946 | 10/1977 | Rydz et al. | 112/158 E |
| 4,055,131 | 10/1977 | O'Brien et al. | 112/158 E |
| 4,079,683 | 3/1978 | Hanyo et al. | 112/158 F |
| 4,117,791 | 10/1978 | Current et al. | 112/222 |
| 4,236,471 | 12/1980 | Okamato et al. | 112/240 |

FOREIGN PATENT DOCUMENTS

| | | | |
|---|---|---|---|
| 919973 | 2/1963 | United Kingdom | 112/158 F |

*Primary Examiner*—Werner H. Schroeder
*Assistant Examiner*—Andrew M. Falik
*Attorney, Agent, or Firm*—Oblon, Fisher, Spivak, McClelland & Maier

[57] ABSTRACT

A sewing machine in which a presser foot member is detachably or exchangeably mounted to a presser bar. The sewing machine is of a pattern indicator type representing a desired stitch pattern in shape and coloring. The presser foot member is provided with a color indication. Thus, a correct presser foot member corresponding to desired pattern stitch is easily selected for mounting to the presser bar by identifying the coloring of the pattern indicator with the color indication of the presser foot member.

21 Claims, 8 Drawing Figures

COLOR CODED PRESSER FOOT ASSEMBLY

BACKGROUND OF THE INVENTION

Field of the Invention

This invention is a continuation-in-part of U.S. application Ser. No. 3,420 filed Jan. 15, 1979, now abandoned, and relates to a sewing machine, more particularly to the sewing machine in which a presser foot member is detachable or exchangeably mounted to a presser bar in accordance with a desired stitch pattern.

DESCRIPTION OF THE PRIOR ART

In a conventional type of sewing machine, it is difficult to easily and speedly select a correct presser foot member from a plurality of presser foot members in accordance with a desired stitch pattern because selection of the presser foot is accomplished by referring to an instruction chart in which a plurality of presser foot members and a corresponding number of stitch patterns are illustrated correspondingly.

SUMMARY OF THE INVENTION

One of the objects of this invention, therefore, is to provide a sewing machine without the aforementioned difficulties.

Another object of this invention is to provide a sewing machine in which a correct presser foot member corresponding to desired pattern stitch is easily and speedily selected by matching colors.

A further object of this invention is to provide a sewing machine in which a desired stitch pattern is represented in shape and coloring to thereby easily select a corresponding presser foot member by matching the coloring with a color indication of the presser foot member.

BRIEF DESCRIPTION OF THE DRAWINGS

Various other objects, features and attendant advantages of this invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENT

Figure 2:
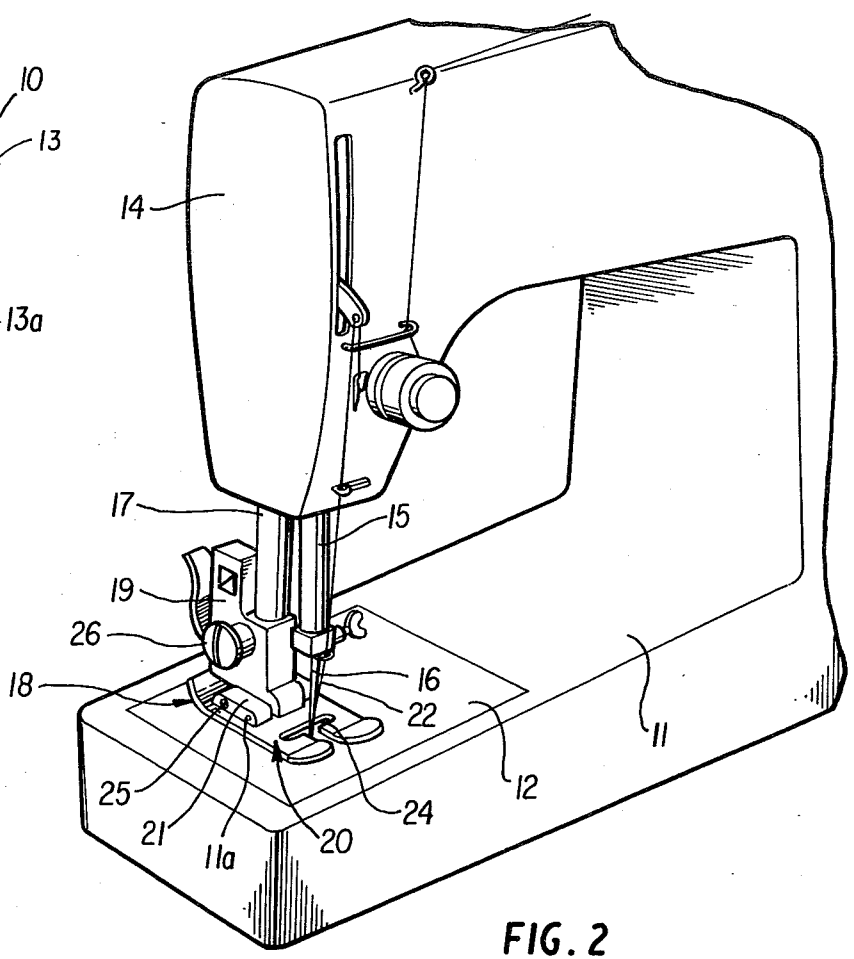
FIG. 2 is a partial perspective view of a sewing machine in which a presser foot member mounted to a presser bar is illustrated in detail.
Figure 1:
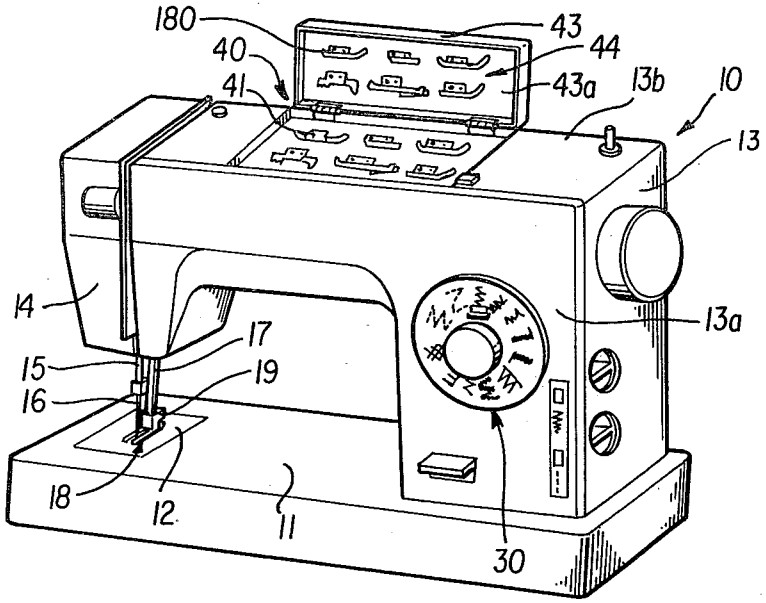
FIG. 1 is a perspective view of a sewing machine according to this invention.
Figure 3:
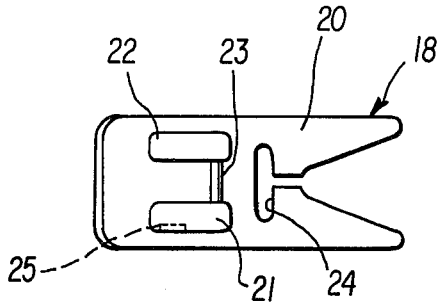
FIG. 3 is an enlarged plan view of a presser foot.
Figure 4:
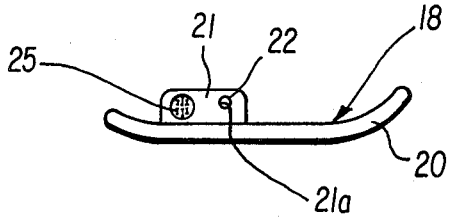
FIG. 4 is a front view of the presser foot member of FIG. 3.
Figure 7:
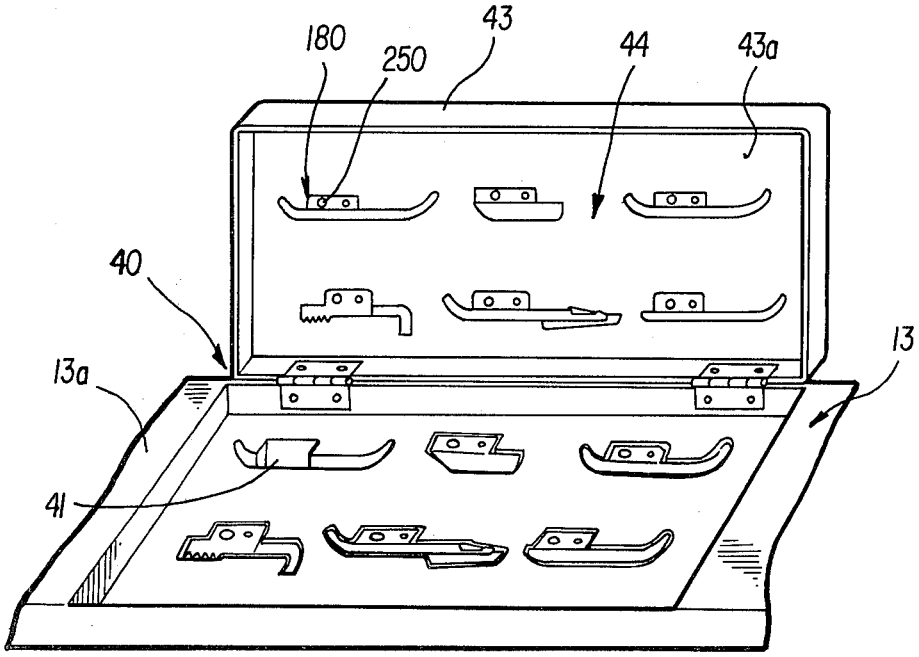
FIG. 7 is an enlarged view of a storing mechanism.
Figure 5:
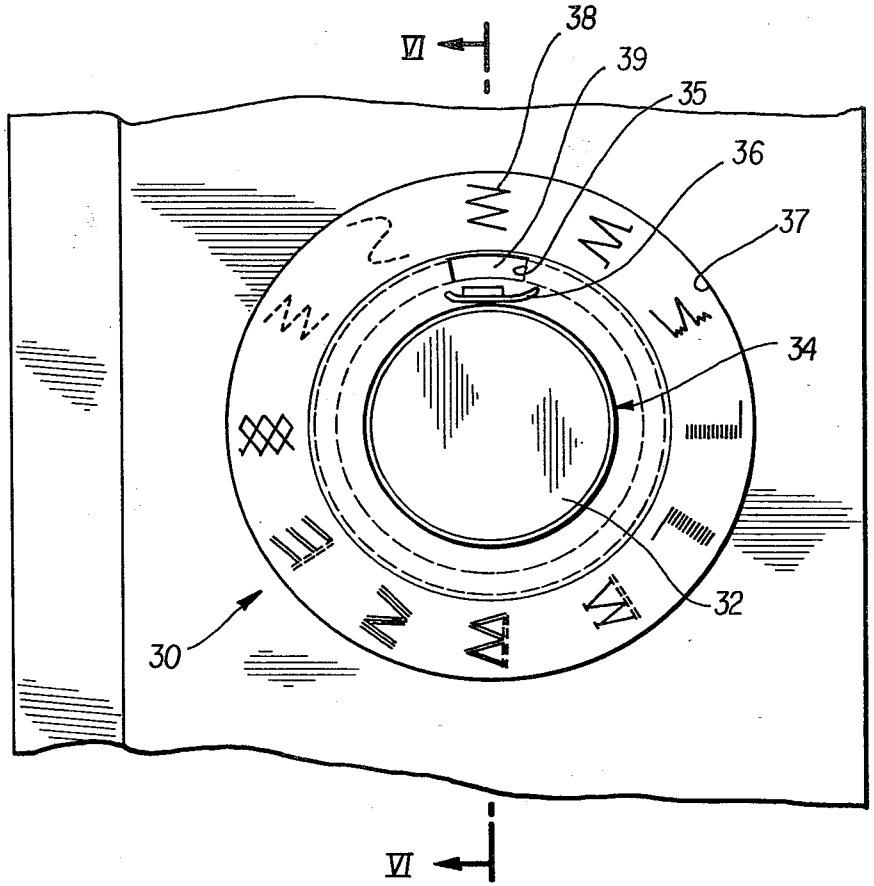
FIG. 5 is an enlarged front view of a pattern indicating assembly.
Figure 6:
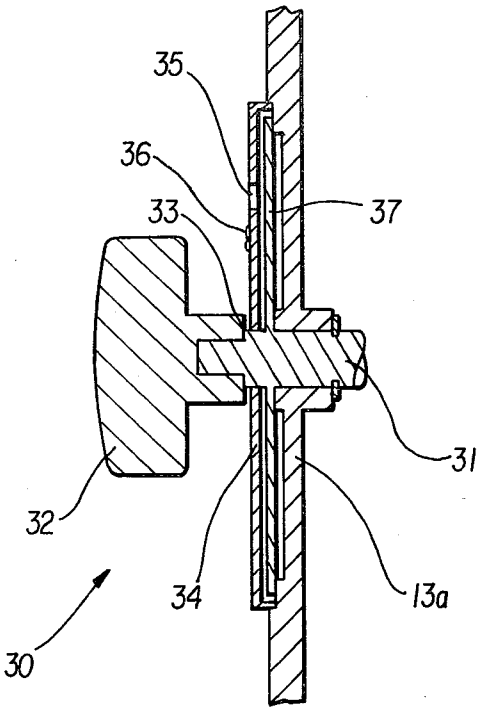
FIG. 6 is a cross sectional view taken along a line V—V in FIG. 5.

Reference numeral 10 generally designates a zig-zag sewing machine. Sewing machine 10 has a bed 11 including a throat plate 12 at the left end portion thereof, and an overhanging arm 13 terminating in a head 14 extending from the right end portion of the bed 11.

In head 14 is reciprocably mounted a needle bar 15 carrying a needle 16. A presser bar 17 is vertically movable between raised and depressed positions in the head 14, and a presser foot member for pressing the work (not shown) onto the throat plate 12 is detachably mounted to the presser bar 17 via a connecting member 19 directly rearwardly of the needle 16.

In detail, presser foot member 18 includes a plate 20, a pair of laterally spaced parallel projections 21 and 22, a pin 23, a needle hole 24 and a color indication 25. The projections 21 and 22 are formed continuously from the upper face of the plate 20. One end of the pin 23 is inserted by pressing the same into a hole 21*a* of the projection 21 and the other end of the pin 23 is inserted by pressing the same into a hole (not shown) in the projection 22. Pin 23 is engageble with the connecting member 19 which is engaged with the presser bar 17 by a screw 26. Thus, the presser foot member 18 is detachably mounted to the presser bar 17 and is movable vertically together with the presser bar 17.

At the front side 13*a* of arm 13 is provided a pattern indicating mechanism 30 which is operatively connected to a pattern selecting mechanism (not shown) in a well known manner. The pattern indicating mechanism 30 represents a desired stitch pattern and one or more colors corresponding thereto.

A shaft 31 is rotatably passed through the front side 13*a* of the arm 13. The left end portion of shaft 31 is connected to a dial 32 and the right end portion of the shaft 31 is operatively connected to the pattern connecting mechanism. Shaft 31 also loosely passes through a central hole 33 of a large disc 34 of transparent material. Large disc 34 is secured to the front side 13*a* of the arm 13 at the outer periphery thereof, has a sector window 35 and is provided with a pointing mark 36 at an inward portion in a radial direction. Between the large disc 34 and the front side 13*a* of the arm 13, there is rotatably mounted a small disc 37 which is extended radially outwardly from the shaft 31 so that the small disc 37 may be rotated together with the shaft 31. On small disc 37 are provided a plurality of stitch pattern representations 38 corresponding to color sectors 39 located at an inward position in a radial direction. That is to say, a combination of color sectors 39 and the pattern stitch representations 38 are in turn arranged outwardly in a radial direction. Only one of the color sectors 39 may be seen through the sector window 35 and may be opposed to or pointed out by the pointing mark 36.

At the top of the horizontal portion 13*b* of the arm 13 is provided a storing member 40 for storing the presser foot members 18 therein. The storing member includes a plurality of concave portions 41 identical to corresponding presser foot members 18, respectively, and a cover member 43 hinged to the arm 13. At the undersurface 43*a* of the cover member 43 is provided an arrangement plan 44 so that the presser foot members 18 may be placed in or removed from concave portions 41 easily and speedily. In other words, a plurality of indicia 180 are utilized showing the shape of corresponding presser foot members 18 having coloring 250 matched with the color indication 25 of the presser foot member 18.

Figure 8:
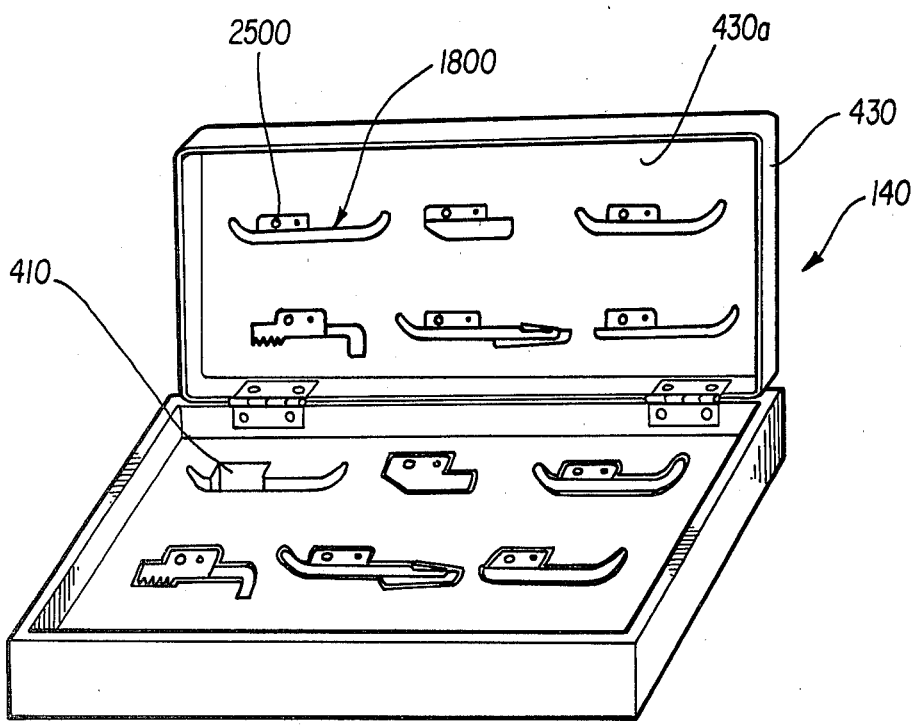
FIG. 8 is a perspective view showing the storing mechanism formed into one unit.

Therefore, stored positions of the correct presser foot member may be quickly determined by matching the coloring 250 of the indicia 180 with the color indication 25 of the presser foot member 18 with the result being that the correct foot presser may be easily selected. In addition, the storing member may be formed as one unit 140 which is separate from the arm 13 as seen from FIG. 8. The storing member 140 includes a plurality of concave portions 410 and a cover member 430 is provided at under surface 430*a* thereof a plurality of indicia 1800 showing the shapes of corresponding presser foot members 18 thereto and having coloring 2500.

Though detailed description is omitted, some of the color sectors 39 are respectively painted with two colors. In such case, two presser foot members 18 have to be selected in accordance with the two colors in color sectors 39 and have to be exchanged during the course of sewing operation due to complicated stitch patterns.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A sewing machine comprising:

a bed including a throat plate;

an overhanging arm extending from said bed and terminating in a head;

a needle bar reciprocably positioned in said head;

a needle carried by said needle bar;

a presser bar movable vertically between a raised and depressed position in said head;

a pattern selecting mechanism operatively associated with said arm;

pattern indicating means operatively connected to said pattern selecting mechanism and representing a desired stitch pattern in shape and color;

presser means including a plurality of presser foot members each being detachably mountable to said presser bar directly rearwardly of said needle in accordance with said color wherein each of said plurality of presser foot members has a color indication means thereon corresponding to one of the colors of said pattern indicating means for indication of stitch pattern, and wherein said pattern indication means further comprises:

a shaft rotatably passed through a front side of said arm;

a dial connected to one end portion of said shaft at a front position of said arm for rotating said shaft;

a first disc rotatable together with said shaft;

a plurality of representations for indicating a desired stitch pattern by shapes provided on said first disc on the circumference thereof;

a plurality of color sectors corresponding to said representations for indicating a desired stitch pattern by colors provided on said first disc on the circumference thereof; and marking means for pointing out one of said color sectors.

2. A sewing machine as set forth in claim 1, said presser foot further comprising;

a plate for pressing a work including an upper surface and a needle hole formed therein;

a pair of laterally spaced parallel projections formed continuously from said upper surface of said plate; and a pin interconnecting said projections and connected to said presser bar.

3. A sewing machine as set forth in claim 2, wherein said color indication means is positioned on a suitable portion of an outer side wall of one of said projections.

4. A sewing machine as set forth in claim 1, wherein said color sectors are positioned inwardly of said representations.

5. A sewing machine as set forth in claim 4, wherein said marking means is of a similar shape to that of a side view of said presser foot member.

6. A sewing machine as set forth in claim 5, further comprising a support member secured to a front side portion of said arm wherein said marking means is applied on said support member.

7. A sewing machine as set forth in claim 6, said support member comprising a second disc of transparent material positioned coaxially with and loosely connected to said shaft between said dial and said first disc.

8. A sewing machine as set forth in claim 7, said second disc further comprising a sector window for viewing said color sector therethrough outwardly of said marking means.

9. A sewing machine comprising:

a bed including a throat plate;

an overhanging arm extending from said bed and terminating in a head;

a needle bar reciprocably positioned in said head;

a needle carried by said needle bar;

a presser bar movable vertically between a raised and depressed position in said head;

a pattern selecting mechanism operatively associated with said arm;

pattern indicating means operatively connected to said pattern selecting mechanism and representing a desired stitch pattern in shape and color; and presser means including a plurality of presser foot members each being detachably mountable to said presser bar directly rearwardly of said needle in accordance with said color wherein each of said plurality of presser foot members has a color indication means thereon corresponding to one the colors of said pattern indicating means for indication of stitch pattern, wherein said sewing machine further comprises storing means for storing said plurality of presser foot members.

10. A sewing machine as set forth in claim 9, said storing means including a plurality of concave portions formed therein for placement of said presser foot members respectively therein.

11. A sewing machine as set forth in claim 10, said storing means further comprising a cover including display means of each of said presser foot members on the under surface thereof for accurate insertion and removal of said presser foot members.

12. A sewing machine as set forth in claim 11, said display means comprising a plurality of indicia showing shapes of said presser foot member and corresponding coloring.

13. A sewing machine as set forth in claim 12, said storing means being positioned at a top portion of a horizontal portion of said arm.

14. A sewing machine as set forth in claim 13, said cover being hinged to said arm.

15. A sewing machine as set forth in claim 11, said storing means comprising a single unit seperable from said arm.

16. A sewing machine comprising:

a arm member;

a pattern selecting mechanism operatively associated with said arm;

pattern indicating means operatively connected to said pattern selecting mechanism and representing a desired stitch pattern in shape and color wherein said pattern indicating means further comprises a shaft rotatably passed through a front side of said arm;

presser means including a plurality of presser foot members wherein each of said plurality of presser foot members has a color indication means thereon corresponding to one of the colors of said pattern indicating means for indication of stitch pattern;

a dial connected to one end portion of said shaft at a front position of said arm for rotating said shaft;

a first disc rotatable together with said shaft;

a plurality of representations for indicating a desired stitch pattern by shapes provided on said first disc on the circumference thereof;

a plurality of color sectors corresponding to said representations for indicating a desired stitch pattern by colors provided on said first disc on the circumference thereof; and marking means for pointing out one of said color sectors such that a specific presser foot can be selected from said plurality of presser foot members.

17. A sewing machine as set forth in claim 16, wherein said color sectors are positioned inwardly of said representations.

18. A sewing machine as set forth in claim 17, wherein said marking means is of a similar shape to that of a side view of a respective presser foot member of said plurality of presser foot members.

19. A sewing machine as set forth in claim 18, further comprising a support member secured to a front side portion of said arm wherein said marking means is applied on said support member.

20. A sewing machine as set forth in claim 19, wherein said support member further comprises a second disc of transparent material positioned coaxially with and loosely connected to said shaft between said dial and said first disc.

21. A sewing machine as set forth in claim 20, wherein said second disc further comprises a sector window for viewing said color sector therethrough outwardly of said marking means.

* * * * *